United States Patent [19]

Bailey et al.

[11] 4,082,409

[45] Apr. 4, 1978

[54] ELECTRICAL COUPLER AND ADAPTER

[75] Inventors: James R. Bailey, Chicago; Vernon W. Lavigne, Rolling Meadows, both of Ill.

[73] Assignee: Switchcraft, Inc., Chicago, Ill.

[21] Appl. No.: 769,851

[22] Filed: Feb. 18, 1977

[51] Int. Cl.[2] ..... H01R 17/18

[52] U.S. Cl. ..... 339/182 R; 339/205

[58] Field of Search ..... 339/182 R, 182 L, 182 RS, 339/182 T, 183, 205, 210 R, 210 M, 177 R

[56] References Cited

U.S. PATENT DOCUMENTS

| | | | |
|---|---|---|---|
| 2,967,901 | 1/1961 | Priaroggia | 339/205 |
| 3,321,732 | 5/1967 | Forney, Jr. | 339/205 |
| 3,437,982 | 4/1969 | O'Keefe et al. | 339/177 R |

*Primary Examiner*—Neil Abrams

*Attorney, Agent, or Firm*—Richard L. Johnston

[57] ABSTRACT

An electrical coupler and adapter is provided which is simple to make and can be used for coupling electrical plugs of the tip and ring type and of different sizes either for two-conductor circuits or three-conductor circuits.

7 Claims, 9 Drawing Figures

ELECTRICAL COUPLER AND ADAPTER

BACKGROUND

Various types of electrical couplers are known in the art as illustrated, for example, by U.S. Pat. No. 3,885,849. However, there is a need for an electrical coupler which is simpler to construct and which can be adapted to connect together electrical circuits through electrical plugs of the tip and ring type which are of the same or different diameters.

OBJECTS

One of the objects of the present invention is to provide a new and improved electrical coupler and adaptor for electrical plugs of the tip and ring type which is relatively simple to construct and quite versatile in its capability of being used for connecting electrical plugs of the tip and ring type either of the same or different diameters.

Another object of the invention is to provide an electrical coupler and adaptor of the type described which by relatively simple changes in construction can be employed either as a 2-conductor coupler or as a 3-conductor coupler.

Other objects and advantages will appear from the following description in conjunction with the accompanying drawing.

THE DRAWING

Figures 1, 2, 3, 4, 5, 6, 7, 8, 9:
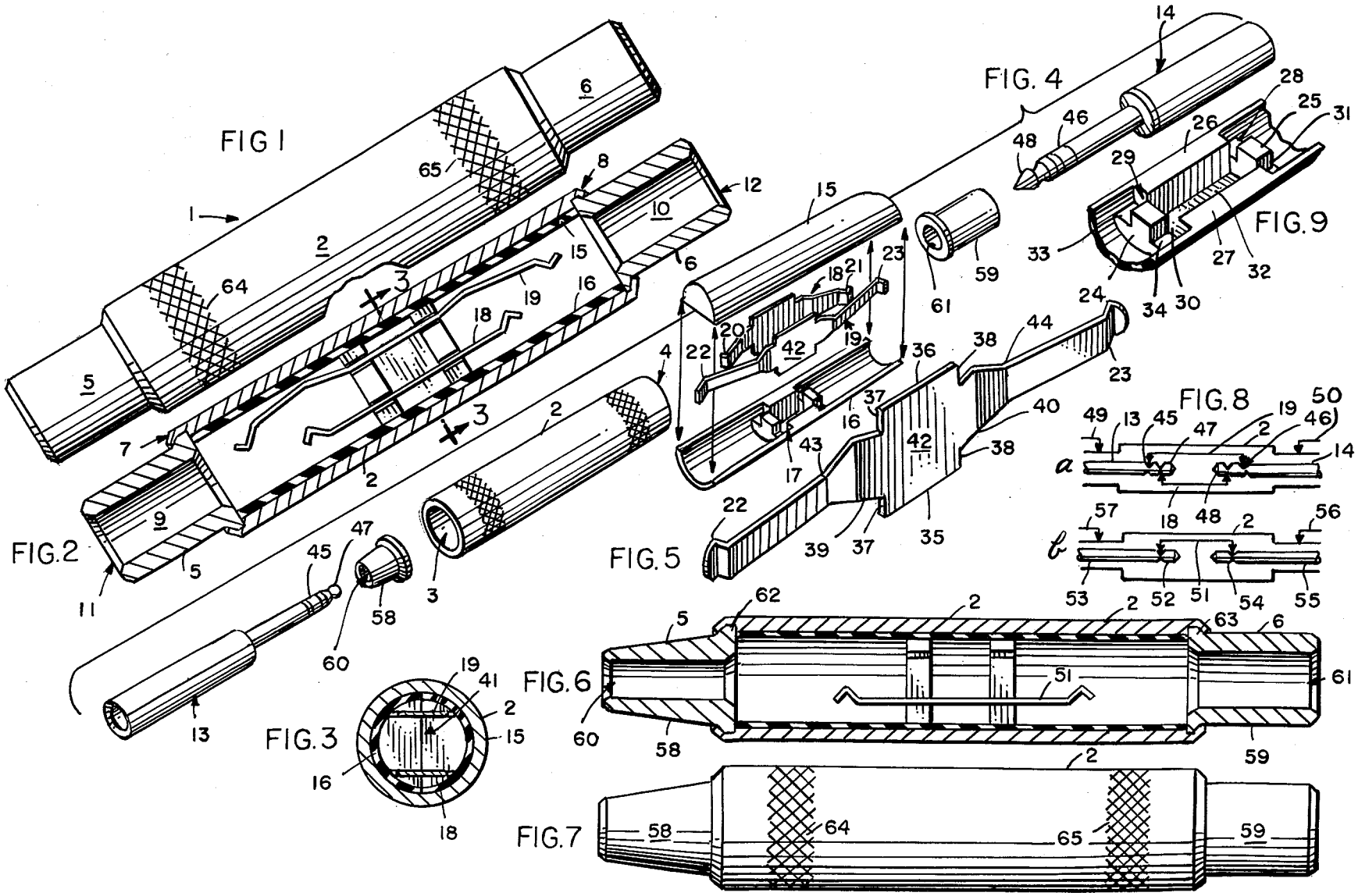
FIG. 1 is a side elevational view, partly broken away, of one embodiment of the electrical coupler and adapter of this invention.
FIG. 2 is a vertical cross sectional view taken centrally from end to end of the coupler and adapter shown in FIG. 1.
FIG. 3 is a cross sectional view taken along the lines 3,3 of FIG. 2.
FIG. 4 is an exploded view of another embodiment of the coupler and adapter of the present invention illustrating in perspective the various components and the manner in which they are assembled and used to connect different sized plugs of the tip and ring type.
FIG. 5 is a perspective view of one of the spring metal contactors employed as a component of the electrical coupler and adapter.
FIG. 6 is a cross sectional view taken lengthwise of another embodiment of the invention illustrating a coupler and adapter for coupling electrical plugs of the tip and ring type and of different sizes in a 2-conductor circuit.
FIG. 7 is a side elevational view of the coupler and adapter illustrated in FIG. 6.

FIG. 8 illustrates diagrammatically (a) a 3-conductor circuit formed by utilizing a coupler and adaptor of the present invention, and (b) a 2-conductor circuit formed by utilizing a coupler and adapter of the present invention; and FIG. 9 is a perspective view, partly broken away, of a semi-tubular electrically insulating insert employed in the coupler and adaptor of the present invention which also contains mounting means to hold one or more resilient electrically conducting elongated contacting members, portions of which are shaped to contact the tip or ring of an electrical plug of the tip and ring type.

BRIEF SUMMARY OF THE INVENTION

In accordance with the invention an electrical coupler and adapter for electrical plugs of the tip and ring type is provided comprising: (a) an elongated electrically conducting tubular sleeve having opposing open ends, (b) opposing electrically conducting bushings mounted in said opposing ends of (a), said bushings each having an opening therein to receive an electrical plug of the tip and ring type, (c) a pair of complemental semi-tubular electrically insulating inserts disposed inside an intermediate portion of said sleeve, said inserts having mounting means to hold between them one or more resilient electrically conducting elongated contacting members portions of which are shaped to contact the tip or ring of an electrical plug of the tip and ring type, and (d) one or more resilient electrically conducting elongated contacting members having central portions thereof mounted in said mounting means of (c) and opposing end portions shaped to contact the tip or ring of an electrical plug of the tip and ring type when said plug is inserted into said opening in said bushing of (b).

The sleeve of (a) of the electrical coupler and adapter can be united with the bushings of (b) in any suitable manner but they are preferably crimped together. The opposing bushings can have openings therein of the same or different diameters to receive different sized plugs.

Another feature of the invention is the unique structure of the electrically insulating inserts which makes it possible to readily assemble and hold one or more resilient electrically conducting elongated contacting members.

DETAILED DESCRIPTION OF THE INVENTION

In the embodiment of the invention shown in FIG. 1, the electrical coupler and adapter 1 comprises an elongated electrically conducting tubular sleeve 2 having opposing open ends 3 and 4 as shown in FIG. 4. A pair of opposing electrically conducting bushings 5 and 6 are mounted in the opposing ends of sleeve 2 and the ends of sleeve 2 are crimped at 7 and 8 as shown in FIG. 2, thereby firmly uniting the bushings 5 and 6 with the sleeve 2. The bushings 5 and 6 have internal passageways 9 and 10 and open ends 11 and 12 to receive electrical plugs of the tip and ring type 13 and 14 as illustrated in FIG. 4.

The sleeve 2 and the bushings 5 and 6 are made of brass or a brass alloy or other suitable electrically conducting material so that one circuit of the electrical plug can pass through the bushings and sleeve of the coupler and adapter.

A pair of complemental semi-tubular electrically insulating inserts 15 and 16 as illustrated in FIG. 4 have mounting means 17 in each insert to hold between the inserts resilient electrically conducting elongated contacting members 18 and 19, portions of which are shaped at 20, 21, 22 and 23 to contact the tip or ring of an electrical plug of the tip and ring type when the latter is inserted into the coupling.

The mounting means 17 disposed in each of the insulating inserts comprises opposing pairs of block-like members integrally molded in each of the inserts, said members in one insert facing said members in the opposite insert. Each pair of members in each insert has spaced corners to permit insertion of the contacting members. Thus, as shown in FIG. 9, there are two opposing block-like members 24 and 25 in a lengthwise direction of each of the insulating inserts 15 and 16 and two opposing block-like members 26 and 27 in a transverse direction in each of the insulating inserts 15 and 16. The corners between the block-like members 25 and 26, 26 and 24, 24 and 27, and 27 and 25 are spaced to provide spaces 28, 29, 30 and 31 to receive the contacting members 18 and 19.

The area defined by the block-like members 24, 25, 26 and 27 has a flat bottom 32 which is somewhat deeper than the portions 33 and 34 of each of the members 24 and 25, thereby forming a step which is adapted to receive the portions 35 and 36 of a contacting member 18 or 19 of the type illustrated in FIG. 5. The portions 37 and 38 form a step upwardly from the bottom 32 of the insulating insert and the portions 39 and 40 of the contacting member can rest and be supported by the areas 33 and 34 of the block-like members 24 and 25. Thus, the contacting members can be fitted within the inserts to form a sub-assembly of the contacting members and the insulating inserts which can then be pushed into the end of sleeve 2 after which the bushings 5 and 6 can be assembled and crimped or otherwise united with the open ends of sleeve 2 in the manner previosuly explained.

When the assembly is complete, the cross section will have the appearance shown in FIG. 3 with the insulating inserts 15 and 16 facing each other and in contact with one another at 41. The contacting members 18 and 19 will extend lengthwise in the insulating insert and will be held transversely between the two complemental insulating inserts.

It will be noted for the purpose of the invention that the contacting members 18 and 19 are preferably formed with a rectangular central portion 42 shaped to form steps at 37 and 38 which fit into the area 32 of opposing insulating inserts.

The contacting members 18 and 19 can be constructed of any suitable flat spring metal which is electrically conducting. Each of the contacting members is preferably shaped or bent at 43 and 44 to facilitate proper contact with the tip and ring elements of electrical plugs 13 and 14.

The insulating inserts can be made of any suitable electrically insulating material preferably a polymer-type material which is capable of being molded or shaped into a configuration of the type described. Many different types of thermoplastic or thermosetting resins are known which can be employed for this purpose.

It will be observed that in the embodiment illustrated in FIGS. 1 and 2 there are two contacting elements 18 and 19 so that the coupler and adapter can be used to form a 3-conductor circuit as illustrated in FIG. 8(*a*) wherein the plug 13 is connected through the ring 45 and contactor 19 to ring 46 of plug 14. The tip 47 of plug 13 is connected to tip 48 of plug 14 through contactor 18. The third component of the circuit is established from plug 13 at 49 through sleeve 2 to plug 14 at 50.

Where a 2-conductor circuit is to be coupled, the arrangement shown in FIG. 6 can be used in which there is only a single contactor 51, the second conductor being sleeve 2. This type of circuit is illustrated in FIG. 8(*b*) where the tip 52 of plug 53 is connected to the tip 54 of plug 55 and the second circuit is established through 56 of plug 55, sleeve 2 and 57 of plug 53.

It will be seen in the exploded view of FIG. 4 that the bushings 58 and 59 are of different sizes and have openings 60 and 61 of different diameters so as to be capable of receiving plugs of different diameters. A similar arrangement is shown in FIGS. 6 and 7. The invention, therefore, makes it possible simply by changing the bushings to provide a number of different variations using the same sleeve with different types of bushings.

As previously indicated, the coupler and adapter is assembled by placing the spring metal contacting members in one of the semi-circular insulating members, then placing the other insulating member in face-to-face relationship with the first insulating member so as to form a tubular sub-assembly containing the contacting members. The tubular sub-assembly is then inserted in one of the openings 3 or 4 in the opposing ends of sleeve 2 and positioned in an intermediate or central portion of the sleeve. The bushings 5 and 6 are then inserted in the opposing ends of sleeve 2 until they contact or abut against the ends of the tubular insulating insert as shown in FIGS. 2 and 6. The bushings have flanges 62 and 63 over which the ends of sleeve 2 are crimped so as to hold the bushings firmly in place, thereby establishing close electrical contact between the bushings and the sleeve so that when a plug is inserted into one of the bushings, the outer conducting circuit of the plug makes electrical contact with the bushing which in turn makes electrical contact with the sleeve, thereby transmitting current through a sleeve circuit from one plug to another. The other circuits are established through one or more spring metal contact members in the manner previously explained. The outer portions of the sleeve 2 are knurled at 64 and 65 so that the coupler and adapter unit can be grasped more easily by the fingers.

The construction described makes it possible to use different sized bushings with the same adapter sleeve. It also makes it possible to use different types of metal spring contactors, depending upon the type of tip and ring plug. Thus, by using bushings having different sized openings, plugs of various diameters can be connected, e.g., 0.250 inch, 0.206 inch, and 0.175 inch diameters. As many as twelve or more variations are possible for like and unlike plugs merely by changing the metal contacting members and the bushings.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. An electrical coupler and adapter for electrical plugs of the tip and ring type comprising:

(a) an elongated electrically conducting tubular sleeve having opposing open ends, (b) opposing electrically conducting bushings mounted in said opposing ends of (a), said bushings each having an opening therein to receive an electrical plug of the tip and ring type, (c) a pair of complemental semi-tubular electrically insulating inserts disposed inside an intermediate portion of said sleeve and extending lengthwise between said bushings, said inserts having mounting means to hold vertically between them one or more resilient electrically conducting flat elongated contacting members portions of which are shaped to contact the tip or ring of an electrical plug of the tip and ring type, and (d) one or more resilient electrically conducting flat elongated contacting members having central portions thereof mounted vertically in said mounting means of (c) and having opposing end portions shaped to contact the tip or ring of an electrical plug of the tip and ring type when said plug is inserted into said opening in said bushing of (b).

2. An electrical coupler and adapter as claimed in claim 1 wherein ends of said sleeve of (a) and said bushings of (b) are crimped together.

3. An electrical coupler and adapter as claimed in claim 1 wherein said openings in said opposing bushings of (b) are of different diameters to receive different sized plugs.

4. An electrical coupler and adapter as claimed in claim 1 wherein said mounting means of (c) comprise opposing pairs of block-like members integrally molded in each of said inserts, said members in one insert facing said members in the opposing insert, each pair in each insert having spaced corners to permit insertion of said contacting members.

5. An electrical coupler and adapter as claimed in claim 4 wherein said block-like members at the inner sides facing each other in each insert form a rectangular recess having a flat bottom area a step deeper than the space between said corners and said contacting members are formed from a flat spring metal having a generally rectangular central portion shaped to form a step which fits into the step in the sides of said bottom area.

6. An electrical coupler and adapter as claimed in claim 1 wherein said coupler is a two conductor coupler.

7. An electrical coupler and adapter as claimed in claim 1 wherein said coupler is a three conductor coupler.

* * * * *